US005314613A

United States Patent [19]

Russo

[11] Patent Number: 5,314,613

[45] Date of Patent: May 24, 1994

[54] PROCESS AND APPARATUS FOR OIL DECONTAMINATION

[76] Inventor: Gaetano Russo, 6 Monaco St., Parkdale, Vic 3194, Australia

[21] Appl. No.: 842,135

[22] PCT Filed: Sep. 25, 1990

[86] PCT No.: PCT/AU90/00446

§ 371 Date: May 18, 1992

§ 102(e) Date: May 18, 1992

[87] PCT Pub. No.: WO91/04309

PCT Pub. Date: Apr. 4, 1991

[30] Foreign Application Priority Data

Sep. 25, 1989 [AU] Australia ..... PJ 6543

[51] Int. Cl.[5] ..... C10M 175/02; C10G 31/06; B01D 19/00

[52] U.S. Cl. ..... 208/184; 208/185; 210/188; 261/116; 261/DIG. 75; 95/255; 95/263; 95/265; 95/266; 96/201; 96/202

[58] Field of Search ..... 208/184, 185; 210/188; 55/53; 261/116, DIG. 75

[56] References Cited

U.S. PATENT DOCUMENTS 4,162,970 7/1979 Zlokarnik ..... 261/DIG. 75

FOREIGN PATENT DOCUMENTS 2172583 2/1985 Australia .

532294 1/1941 United Kingdom .

*Primary Examiner*—R. Bruce Breneman

*Assistant Examiner*—Walter D. Griffin

*Attorney, Agent, or Firm*—Learman & McCulloch

[57] ABSTRACT

A process and apparatus for the decontamination of oil includes providing a jet compressor having a converging section in which high velocity liquid oil compresses a source of atmospheric pressure gas, a central mixing section that intimately mixes the liquid oil with the gas for providing a large gas and oil surface area for the mass transfer of water from the liquid oil, and a diverging section in which the liquid oil and gas are further mixed during pressure recovery. A tubular member is connected to the diverging section to provide a residence time chamber immediately downstream of the diverging section to increase the efficiency of the rate of transfer of water from the liquid oil to the gas.

16 Claims, 6 Drawing Sheets

PROCESS AND APPARATUS FOR OIL DECONTAMINATION

FIELD OF INVENTION

This invention relates to an improved method and apparatus for removing contaminant liquids and gases from oils. The contaminant liquids usually have a high vapour pressure relative to the oil and can either be present as a separate liquid phase or be dissolved in the oil. The contaminant gases are usually dissolved in the oil.

BACKGROUND OF THE INVENTION

Oils in contact with relatively small quantities of a contaminant liquid such as water will dissolve and absorb the liquid up to its saturation limit in the oil. An excess of the contaminant liquid beyond saturation will result in it forming a separate liquid phase within the oil. When the liquid is water, the term free water is used to describe this second liquid phase.

Oil in contact with gases (including water vapour) dissolve these gases generally in accordance with Henry's Law.

Both dissolved liquids and gases can cause problems with oils and with equipment in contact with the oils.

The main contaminant in lubricant and seal oils is water. However, hydrogen sulphide, oxygen, hydrocarbons, and other organic compounds such as alcohols, aldehydes and ketones can be dissolved and absorbed by the oils and can also form separate phases within these oils.

There are several mechanisms by which contaminants adversely effect lubrication oils. For example, when the compounds listed above are absorbed by oil, the oil viscosity is reduced and adversely affected and this affects the ability of the oil to lubricate the moving or bearing surfaces in machinery. The modification to oil viscosity normally leads to a reduction in the thickness of the protective lubricating oil film on the machinery surfaces and metal to metal contact is increased. This leads to high rates of wear and poor machinery performance.

In addition to viscosity effects, water and acid gases such as hydrogen sulphide and hydrogen cyanide cause corrosion to the surfaces they contact. Particles of corrosion products flake off metal surfaces and increase wear via abrasion of the metal surfaces.

Water and volatile gases can also cause erosion of metal surfaces via another mechanism. This erosion is caused on the metal surfaces by the rapid vaporisation that can occur as the lubricating oil containing the volatile gases heats up as it passes through and between the bearings, gears and other highly stressed surfaces causing sudden vaporisation. The resultant rapid increase in oil and gas velocity past the surfaces causes erosion. This is often referred to as cavitation.

Transformer oils are mostly contaminated by water which usually enters in the form of a gas and is absorbed into the oil. The absorbed water reduces the dielectric constant of the oil which leads to inefficiencies within the transformer and in the extreme can lead to an explosion due to arcing and vaporization of the transformer fluids.

Hydraulic oils are mostly contaminated by water which also enters as water vapour normally into the storage compartment. The dissolved water usually causes corrosion within the hydraulic system.

Edible oils, which are normally vegetable oils, contain dissolved water. The water enters the oil during the extraction process from the plant and during oil storage where water vapour condenses from air into the oil. The oil, dissolved water and free water all contain dissolved oxygen. The water in the oil allows the oxygen to act on the oil and cause oxidation and therefore rancidity of the oil, spoiling it as a foodstuff. For this reason, antioxidants are usually added to edible oils. These antioxidants are chemicals which tend to block the oxidation action of oxygen and/or water on oxidizable fractions of the oil. Without these antioxidants, edible oils would rapidly spoil and become unfit for human consumption.

Water is the principal contaminant to be removed from oils to overcome the problems described above. Water can be present in various combinations of the following forms:

Free water which is present as a separate phase from the oil and which separates as such on standing.

Emulsified water which, although present as a separate phase, is so finely dispersed that surface tension forces are not large enough to allow free settling of the water on standing. In general, emulsified water cannot be separated by purely mechanical means.

Dissolved water which is present as a solution within the oil. It is an integral part of the oil phase and cannot be remove by mechanical means (i.e. standing, filtration or centrifuging). Dissolved water exists up to the saturation limit which varies with the type of oil and its temperature. Once the saturation limit is reached, the oil cannot accommodate any more dissolved water and any excess water appears as a separate phase as either free and/or emulsified water.

In addition to water resulting from absorption into the oil from the gaseous phase, oils may be contaminated by liquid water leaking into the oil system, particularly in hydraulic and lubrication oil systems where those systems are normally cooled against cooling water. Water can also enter these systems where it condenses out of the atmosphere above the oil, especially where the oil storage reservoirs are situated in the close proximity of steam turbines or steam vents. These means of gross contamination require extensive water removal if catastrophic failure of the lubrication system and the machinery it is protecting are to be avoided.

Contamination levels of water can vary from a few hundred parts per million through to many thousands of parts per million and some lubrication systems can have periodic gross contamination of up to 10% water in the oil.

The desired level of water in the oil is less than the saturation level for that temperature. For example, most lubrication oils operate in the temperature range 30° C. to 80° C. At 30° C., a typical saturation water level in oil is 100 ppm whereas a typical saturation water level at 80° C. is 500 ppm. However, most lubrication oils give superior performance if water levels of less than 100 parts per million are present in the oil supply to the bearing or gear. A figure of less than 50 ppm in the oil supply would ensure that the oil is in a condition where it has no free water in it and will have the capacitance to absorb any liquid water or any water vapour that comes into contact with the oil. At these low levels, water is not readily available to cause viscosity changes in the oil or to cause corrosion or erosion damage.

PRIOR ART

Commercially available decontamination techniques comprise coalescers, centrifuges and filters that purport to remove free water. The first two items cannot remove dissolved or emulsified water. Furthermore, filters which are commercially available may cause some coalescing of free water for removal but cannot remove dissolved water and dissolved gases and are only effective at removing solid dirt loads.

Vacuum dehydrators can remove all forms of water and dissolved gases. However, they are complex, bulky and therefore costly. It is also very difficult to apply them to small compact systems and they are usually regarded as only viable in large complex systems.

In summary, Prior Art discloses equipments which have limitations to the extent of contaminant removal and all equipments, except for vacuum dehydrators, only remove free water. Although vacuum dehydrators can remove free, emulsified and dissolved water and dissolved gases, they suffer from bulkiness, high cost and low efficiency.

The Shell Company in Australian Patent No. 71431/81 teaches that seal oils can be reclaimed by passing an inert gas countercurrent to the seal oil in either a trayed or packed tower at predetermined pressure and temperatures ranging from 20° C. to 120° C. Forseland in U.S. Pat. No. 4,146,475 teaches the flashing of volatile liquid contaminants in oils but does not provide for a carrier or stripping gas for the removal of the volatile components.

Similarly, Halleron in U.S. Pat. No. 4,261,838 teaches flashing the contaminant components of heated oil under a vacuum but provides no positive stripping means for physically removing the volatile contaminants.

Bloch and Calwell in U.S. Pat. No. 3,977,972 teach that seal oil may be decontaminated and thereby reclaimed by stripping it in a drum supplied with air or nitrogen bubbled through under pressure. The volumetric ratios of gas to liquid on the data presented by Bloch and Calwell required to achieve their objective is broadly between 900:1 and 1800:1, whereas the present invention due to its superior method of mixing and temperature control reduces this ratio to broadly between 3:1 and 9:1.

Russo in Australia Patent No. 554116 teaches that oil contaminants can be removed using dry air or inert gas to strip the contaminants in a flash chamber packed with packing and although one of his four examples contained a nitrogen pump/feed mixer it is apparent that the pump/feed mixer did not have high contact efficiency because of the requirement for packing to be used in the flash chamber to provide suficient surface area for mass transfer.

The reclamation processes taught in the Prior Art suffer from poor efficiencies and/or bulkiness compared to the method and apparatus disclosed in this patent application.

The Shell and Russo disclosures show that trays and/or packing are required by their processes and that countercurrent contacting of the oil and air or inert gas is required. This invention does not require either of the above conditions since neither trays nor packing are required. The method and apparatus disclosed herein has the air or inert gas flowing co-current with the oil.

The Bloch and Calwell disclosures teach that 2 to 4 scfm of air or inert gas are required per square foot of total cross sectional area for seal oil flows of 1 gal per hour. This implies air or inert gas flow to oil flow ratios of between 900:1 to 1800:1 and compares with air or inert gas flow to oil flow ratios achievable with this present invention of between 3:1 and 9:1. All of the aforementioned disclosures that use a stripping process require the stripping medium (air or inert gas) to be supplied at pressure above atmosphere, whereas this present invention draws the medium into the process.

An additional property of the present invention over Prior

Art for lubrication oils is that the combination of the properties of a jet compressor and residence chamber into a single compact component results in an intimate dispersion of the oil into the gas phase and maintains it in this state for an optimal period of time to ensure maximum mass and heat transfer. This enables the efficient removal of minute surface active contaminants, formed by thermal decomposition of the oil, which in the normal course of events, would be retained in the oil and cause emulsification of water with the oil. In contrast to the Prior Art, this invention not only removes volatile liquid and gaseous contaminants, but also deemulsifies the oil by removing the surface active contaminants.

SUMMARY OF THE INVENTION

The objects of this invention are to improve the efficiency of mixing the oil and inert gas or dry air, to eliminate the need to have inert gas or air at a pressure above atmospheric and to improve the efficiency of the process when heat exchangers are used in the process. Even when achieving all of the above, the process remains simple and compact.

This invention provides a simple compact component (hereinafter referred to as a jet compressor residence time chamber) which combines the jet compressor functions of suction, mixing and compression with a residence time chamber. In this arrangement, oil at high velocity draws the inert gas or air into a mixing chamber within the jet compressor where the oil and the inert gas or air are intimately mixed using high shear forces to produce a homogeneous mist of droplets of oil in the gas stream. The mixing chamber is immediately followed by the pressure recovery section of the jet compressor where the pressure of the mixture is increased to enter the residence time section of the device. Here a period of time is given to allow adequate time for mass and heat transfer between the fine dispersion of oil droplets and the surrounding air or inert gas phase. By these means the efficiency of contact and subsequent stripping of the contaminant gases from the oil is greatly improved over the Prior Art taught by Russo.

The advantages of using a jet compressor/residence time tube or chamber compared with other mixing devices such as packed towers or flash drums are that within the one item of equipment one can achieve suction and compression of the stripping inert gas or air, intimate mixing of that inert gas or air with the oil such that the water or the contaminant gas in the oil rapidly comes to equilibrium with the contaminant gas or water vapour in the air or inert gas phase. The apparatus used ensures that the oil phase is intimately and freely dispersed within the air or inert gas phase as the mixture enters and leaves the residence time chamber while in the disengaging or flash drum the air or inert gas is finely dispersed within the oil phase with millions of tiny bubbles per liter of oil. This achieves between 95% and 100% mass transfer efficiency of the water or contaminant gases from the oil to the inert gas or air phase in a single compact apparatus.

Because the jet compressor residence time chamber achieves rapid heat and mass transfer, high temperatures can be used to enhance mass transfer and not be detrimental to the oil because the oil only remains at the high temperatures for a short time.

The exploitation of the synergism of the two effects (rapid heat/mass transfer and temperature) is only possible because of the primary effects resulting from the use of the jet compressor residence time chamber.

The design also ensures that the pressure in the flash drum is kept at a minimum, preferably at atmospheric, to enhance the contaminant carrying capacity of the air or inert gas. At the same time, the gas is drawn into and compressed by the jet compressor section of the device so that air or inert gas does not need to be added from a high pressure source to achieve the mixing. Alternatively, the air or the inert gas can be compressed to sufficiently high pressures such that the oil can be discharged to the flash chamber at sufficient pressure to allow subsequent processing of the oil without the need for a second pump or subsequent processing of the humidified gas without the need for a compressor.

DESCRIPTION OF PREFERRED EMBODIMENTS

Figure 1:
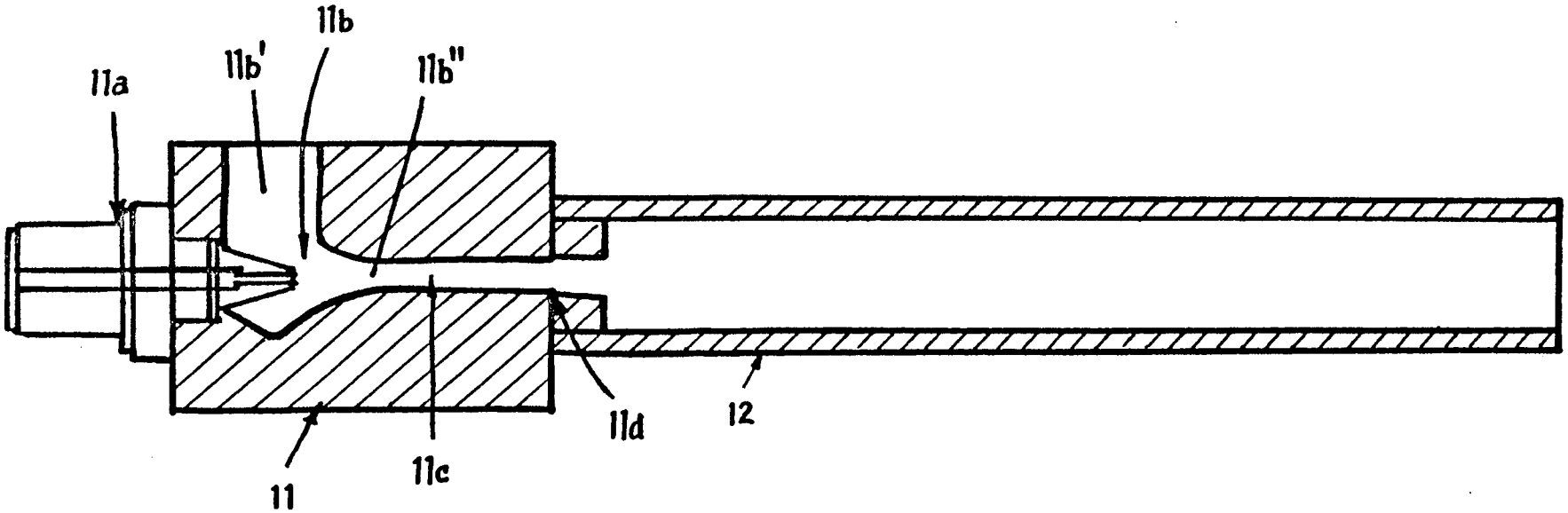
FIG. 1 is a longitudinal sectional view of an air oil mixer including the present invention.
Figure 2:
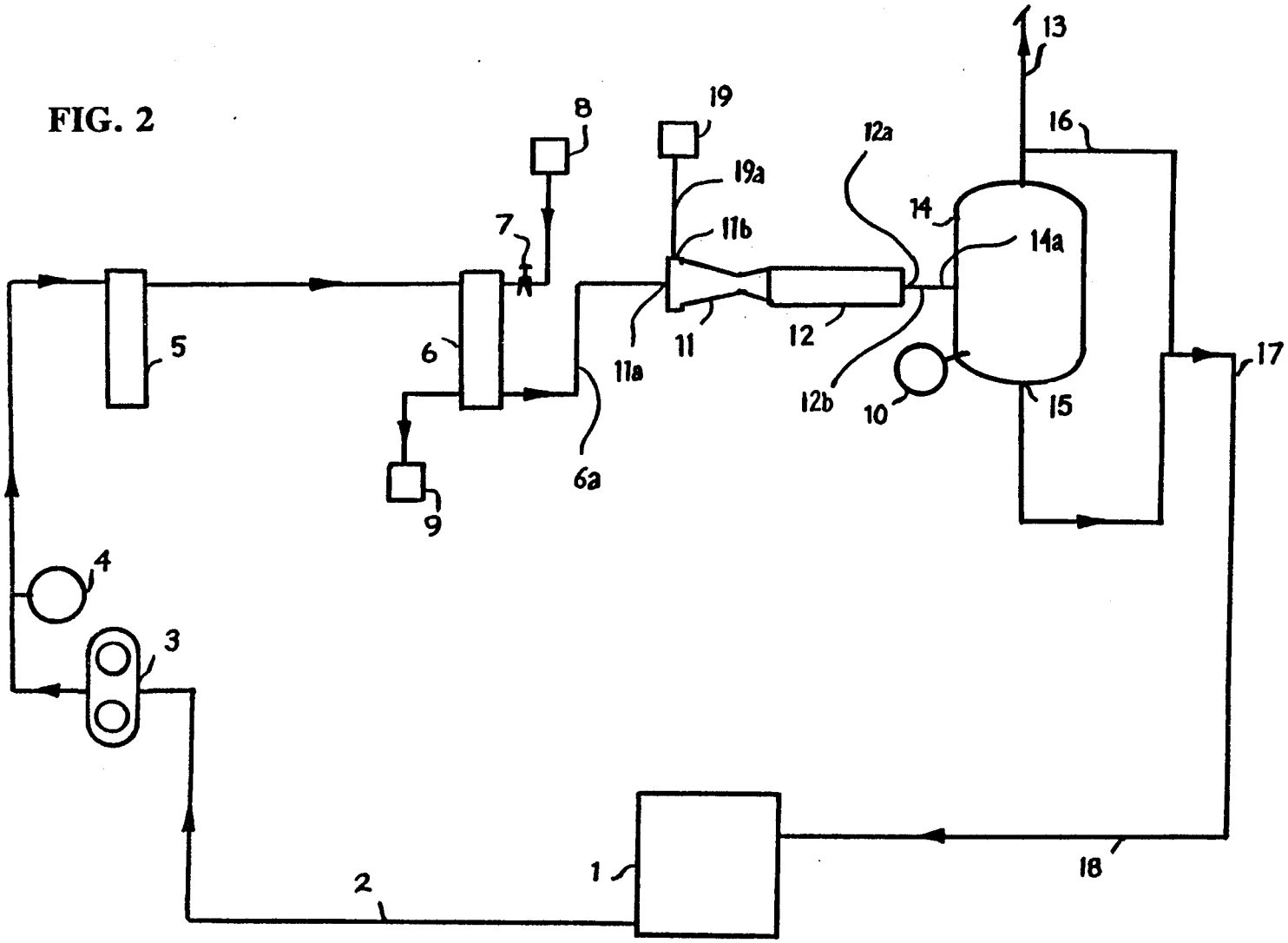
FIG. 2 is a diagrammatic view of apparatus including a first embodiment of the invention for removing contaminant liquids and gases from oils.
Figure 3:
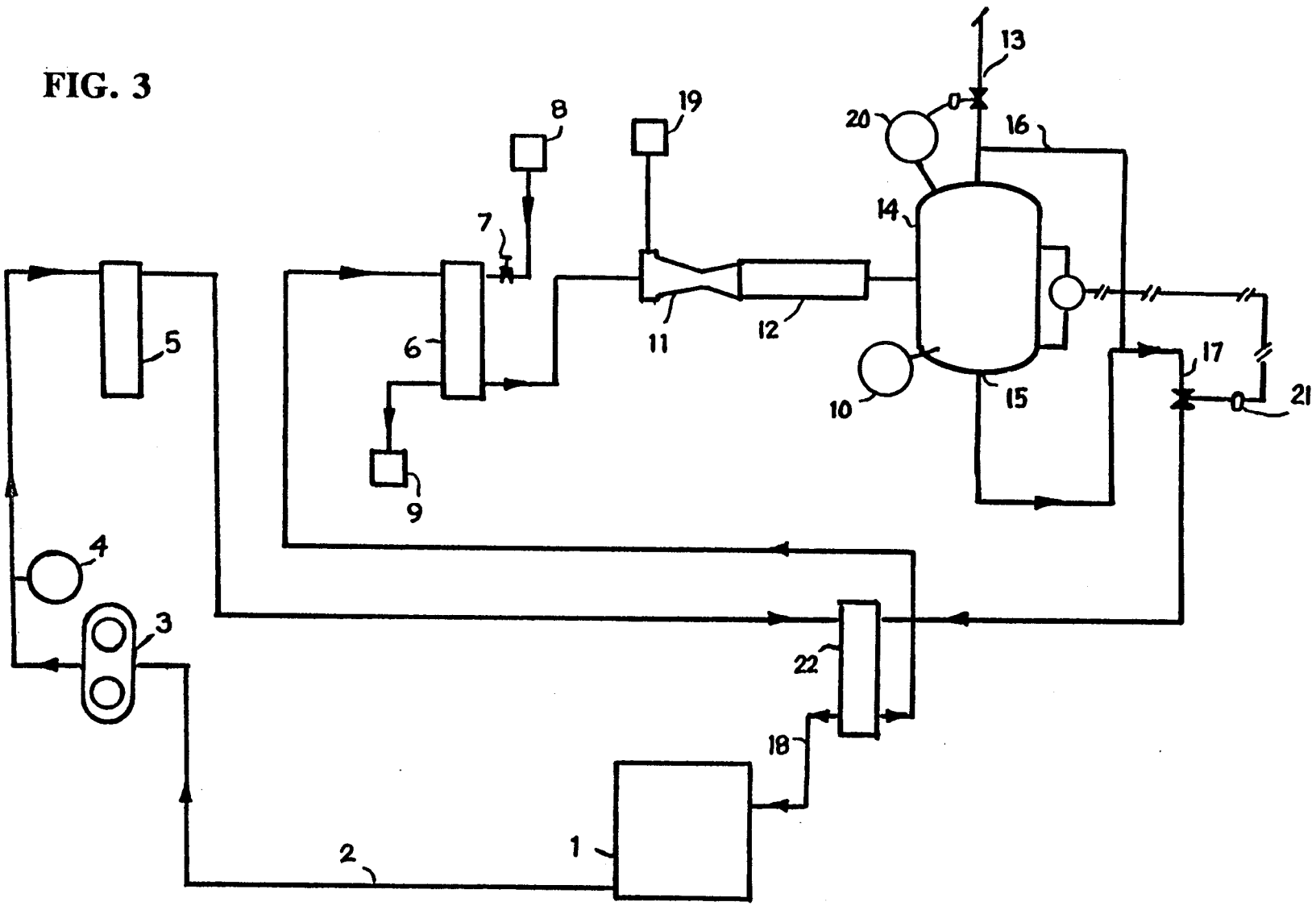
FIG. 3 is a diagrammatic view of apparatus including a second embodiment of the invention.

In order that the invention may be more clearly understood, reference will now be made to the accompanying drawings wherein FIG. 1 shows the jet compressor residence time chamber component details while FIG. 2 is a flow diagram showing the assembled invention in its simplest form, and FIG. 3 showing the assembled invention in a more complex form principally to enhance its thermal efficiency and to enable it to interface more intimately with complex machinery.

FIG. 1 and the following description defines the embodiment of the jet compressor residence time chamber component common to all the embodiments of the total invention defined by FIGS. 2,3,4,5 and 6 and their description following this section. Oil at high pressure and temperature enters the jet compressor (11) through the oil nozzle (11*a*). This produces a low pressure area at the air or inert gas inlet area (11*b*) causing air or inert gas to be drawn into the jet compressor. The air or inert gas is intimately mixed with the oil as it passes through the mixing chamber (11*c*) and the pressure recovery area (11*d*) of the jet compressor.

As shown in FIG. 1, the inert gas inlet area 11*b* includes a feed passage 11*b'* and a converging section 11*b''* through which the oil nozzle 11*a* discharges oil to compress air or inert gas and discharge it to the mixing chamber 11*c* that is centrally located between converging section 11*b''* and a diverging section shown in FIG. 1 at 11*d*. The mixing chamber 11*c* connects the converging section 11*b''* to the diverging section or pressure recovery area 11*d* that is shown in FIG. 1 as a diverging section that flows directly into an elongated tubular member that defines the residence time chamber 12. The residence time chamber 12 has co-current flow of oil and gas mixture therefrom into the interior of the separation drum via the line 12*b* and single inlet 14*a*.

The fine dispersion of oil droplets in the air or inert gas phase is maintained in the residence time chamber (12). This chamber is sized to maintain a stable dispersion and provide sufficient residence time to ensure heat and mass transfer rates are attained to achieve 95% to 100% mass transfer of water or contaminants from the oil to the air or inert gas phase. In practical terms this has required a cross-sectional area to allow a velocity of between 0.5 and 21 m/sec to be attained, corresponding to residence times in the chamber of 0.4 to 0.03 seconds respectively.

With reference to the FIGS. 2, 3, 4, 5 and 6; the oil is taken from the oil storage reservoir (1) through a line (2) to a pump (3) where the pump is preferably a gear pump but maybe any suitable pump for oil service. The pump discharges the oil through a discharge line at a pressure predetermined to be most efficient for the process and indicated on pressure gauge (4). The oil is filtered through filter (5) which is selected to suit the dirt load and quality of the oil to be decontaminated. The filter can be selected to remove solid particles in the range 1 micron to 300 microns although a particle size range between 10 and 125 microns is more preferable. The principal objective of the filter is to remove dirt particles which would otherwise foul downstream equipment.

From the filter the oil is sent to a heat exchanger (6) which is heated by steam (8) which enters the exchanger through a variable orifice (7) and discharges as condensate to a steam trap (9). Alternatively, the heat exchanger may be electrically heated. The oil is discharged from the heat exchanger and enters a jet compressor (11) where its pressure energy is dissipated across a nozzle within the jet compressor.

The dissipation of pressure energy in the jet compressor (11) causes air or inert gas from a source (19) to be drawn into the apparatus and intimately mixed with the oil stream leaving the nozzle (11*a*). The pressure energy dissipated across the nozzle is preferably a minimum of 420 kPa but can be as high as practical considerations dictate (this is usually of the order of 1,200 kPa). The intimately mixed oil and inert gas or air are discharged from the jet compressor into a residence time chamber which is located immediately adjacent to the jet compressor (12). From the residence time chamber the oil/gas mixture enters a disengaging, separation or flash drum (14). This drum is normally operated at atmospheric pressure to maximize contaminant gas removal efficiency. In the separation drum the gas phase separates from the liquid phase; the inert gas or air taking with it water and contaminant gases up to their saturation level and the oil phase leaving the drum from the bottom depleted of its contaminant load. The gas phase exits the system through vent (13). Within the drum there is a temperature measuring device (10) which is used to either set an automatic controller to control the upstream exchanger (6) or used by the operator of the equipment to manually set the exchanger condition.

The oil leaves the disengaging drum through a seal loop (17) which is sized to ensure that the gas phase is sealed from the liquid phase so there is minimum carry-under of gas into the oil phase back to the oil sump or reservoir and the seal loop diameter is sufficiently large to enable the drum to be self draining without the assistance of a pump.

To eliminate the possibility of the seal loop siphoning and causing carry under of gas, a vacuum breaker in the form of a small pipe (16) is tied from the top of the seal loop back to the vent on the separation drum. To ensure that the separation drum is self-draining, its exit nozzle (15) is specified to be at a minimum distance above the oil reservoir. This distance above the reservoir is determined with due regard to the viscosity, temperature and density characteristics of the oil and the diameter of the return line (18).

Figure 4:
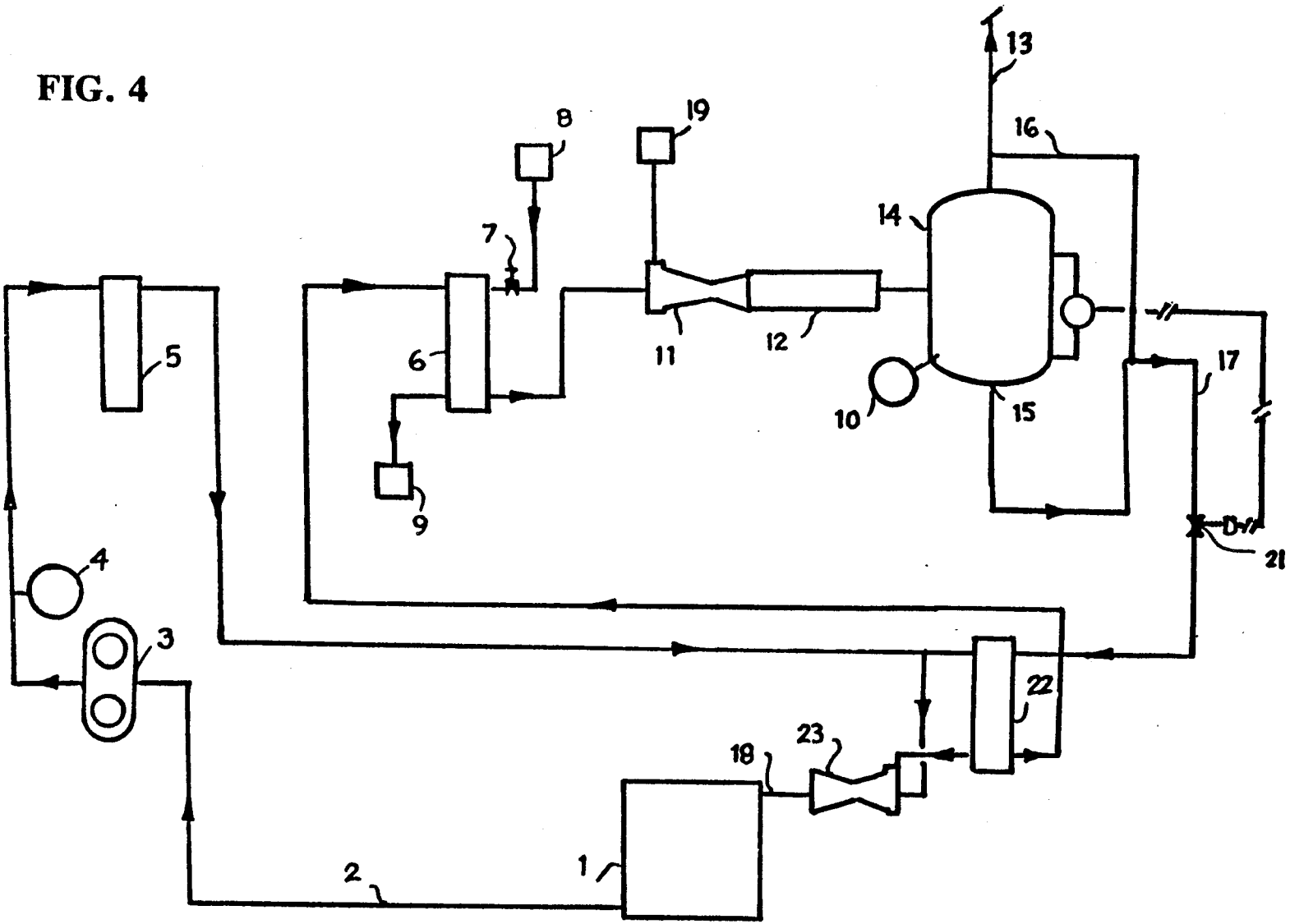
FIG. 4 is a diagrammatic view of apparatus including a third embodiment of the invention.

For larger systems which have to interface with complex lubrication or other oil systems and where heat energy recovery is desired, a number of additions are made which still enable the whole process to be simply constructed using only the one moving component; the feed pump. With reference to FIGS. 3 and 4, this integration and better utilization of heat energy can be achieved by adding a feed effluent exchanger (22) on the effluent line (18).

A pressure control valve and controller (20) on the outlet line from the separation drum enables the jet compressor to build up sufficient pressure within the separation drum to supply the pressure energy to force flow through the feed effluent exchanger and thereby maintain proper control of the level in the separation drum. The actual separation drum level is controlled by a level controller and control valve (21) near the drum. The operation of the separation drum at above atmospheric pressure detracts from the contaminant removal efficiency of the process but is partially compensated for by the thermal efficiency offered by the feed effluent exchanger and maintains the equipment compact and low cost.

FIG. 4 shows an alternative arrangement where a second jet compressor in the form of a liquid jet pump 23 may be added to the discharge line of the flash or separation drum where it is interposed between the feed effluent exchanger and the oil reservoir. This jet compressor, operated by using the discharge liquid from the single feed pump (3) draws oil from the flash drum and pumps it back to the oil reservoir. The flash drum still being level controlled by a level control valve. However, in this case the flash drum can operate at atmospheric pressure and retain the high efficiency of contaminant removal that is achievable at low pressure. High efficiency occurs at low pressure because the contaminant vapour pressure is low and this facilitates mass transfer from the oil phase to the inert gas or air.

Figure 5:
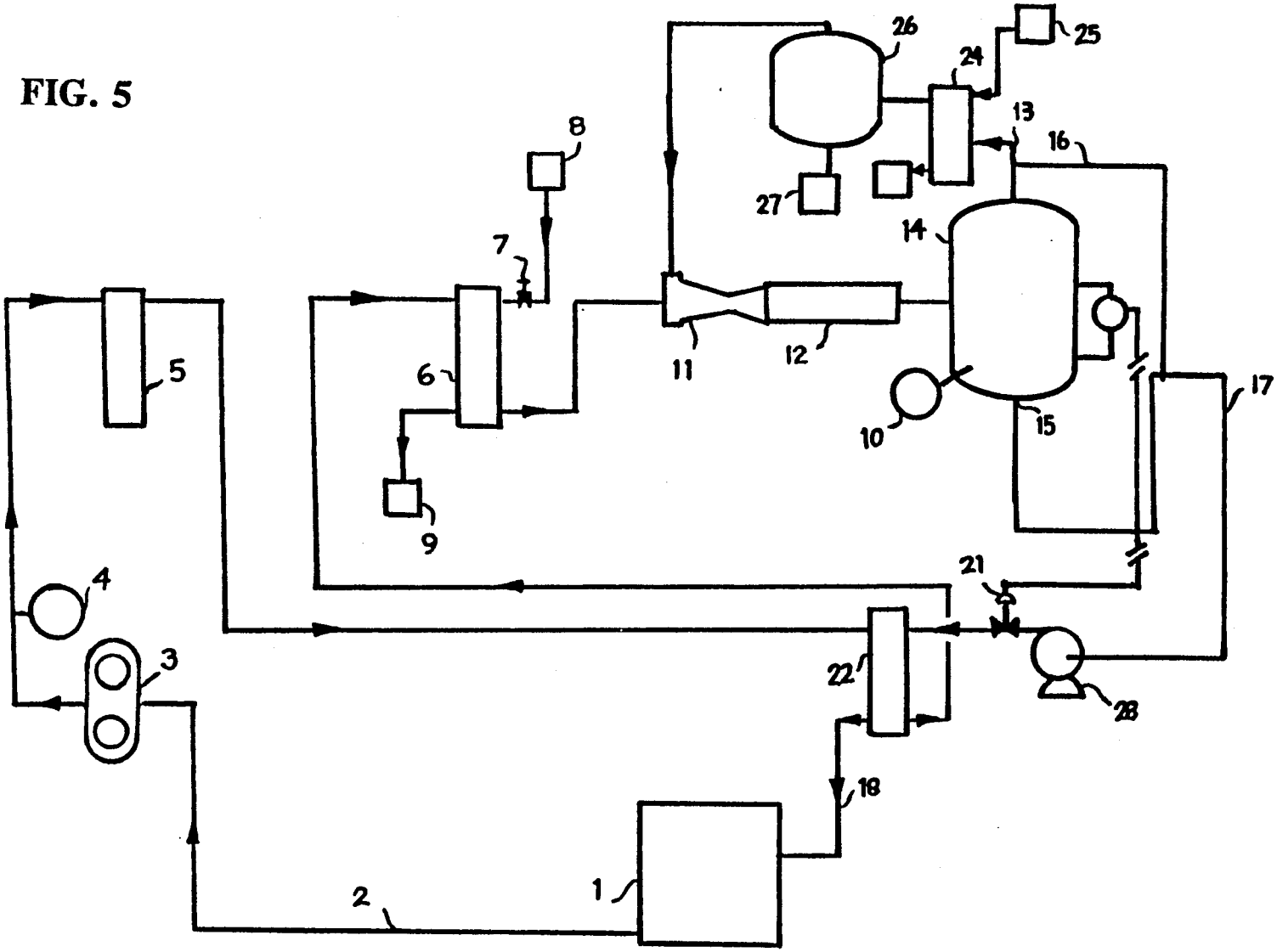
FIG. 5 is a diagrammatic view of apparatus including a fourth embodiment of the invention.

Should it be so desired to economize on an inert gas, it may be closed looped as per FIG. 5 so that the contaminants are condensed out of the vent from the flash drum by condensing against cooling water or refrigerant (25) in a heat exchanger (24) and the condensed contaminants removed in the condensed contaminant separation drum (26). The contaminant liquid is drained through an automatic drain (27) and the overhead dry gas is routed to the gas inlet of the jet compressor (11) so that it may be continuously recycled. By these means, the quantity of inert gas required is greatly reduced which is of great advantage if the inert gas, usually nitrogen, is expensive. This embodiment of the invention provides a second pump (28) which allows the jet compressor to be operated such that the separation drum is kept under vacuum conditions enabling the contaminant carrying efficiency of the circulating gas to be increased further and improving the efficiency of removal of difficult to remove contaminants such as high boiling point hydrocarbons.

Figure 6:
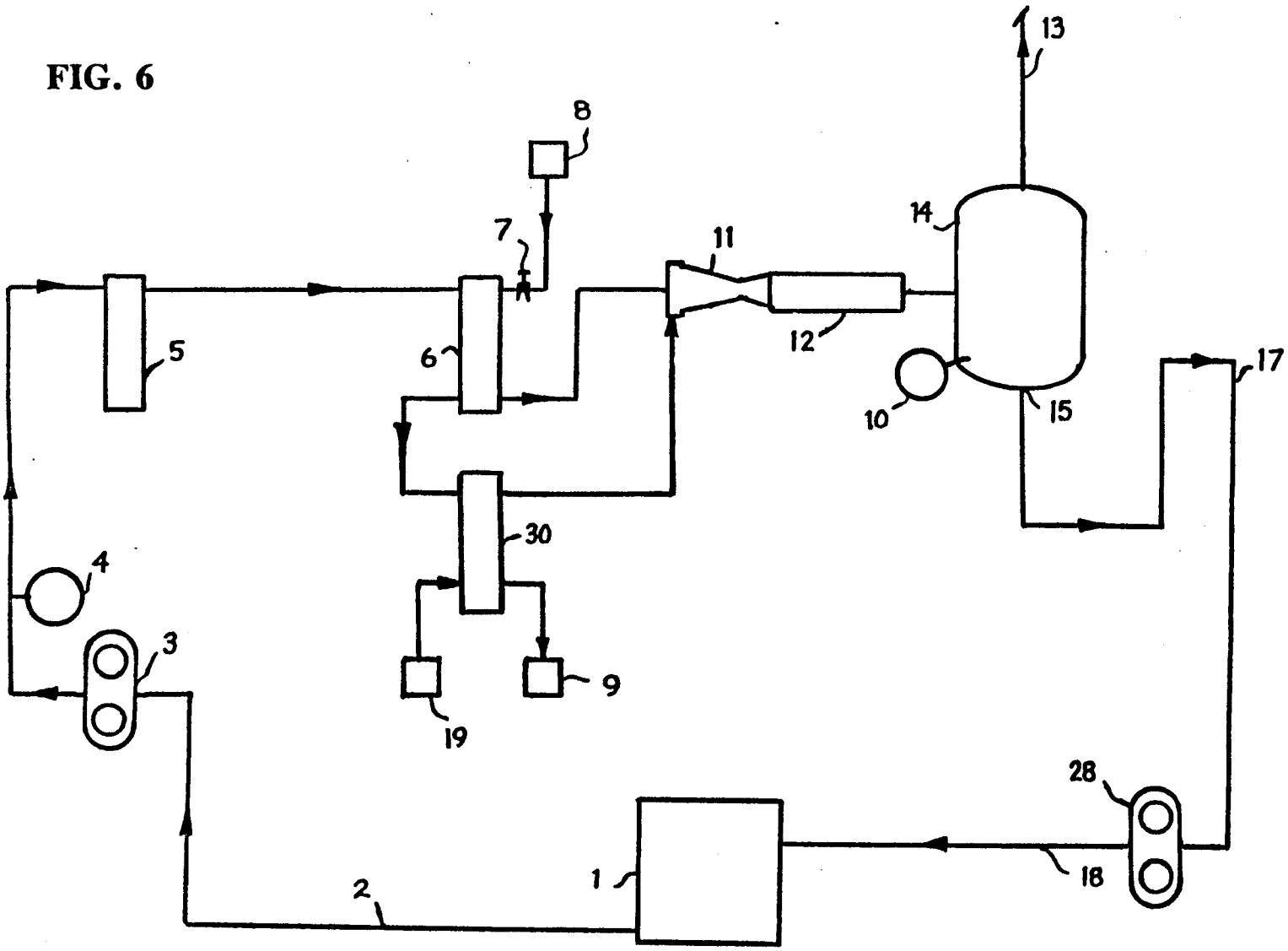
FIG. 6 is a diagrammatic view of apparatus including a fifth embodiment of the invention.

FIG. 6 discloses an arrangement with a second pump (28) to return the decontaminated oil back to the reservoir. In this case, a gear pump is used and has a capacity slightly in excess of the feed pump (3). This arrangement does not require the level controller and valve (21) disclosed in FIGS. 4 and 5. FIG. 6 also discloses a heat exchanger (30) to heat the air or inert gas to improve the efficiency of heat transfer to the air or inert gas and to enable the reduction of oil temperature when decontaminating temperature sensitive oils.

In all cases it is preferable that the construction of the equipment be in non-corroding materials such as stainless steel to ensure that the equipment does not contribute to the contaminant load on the oil system.

I claim:

1. Apparatus for the decontamination of oil which can be lubricating oil, seal oil, hydraulic oil or transformer oil, with the contaminants being water and/or dissolved fuels and/or dissolved gases, comprising a jet compressor having a converging section defining a low pressure region; a oil jet located in said converging section for directing oil therethrough for drawing air or inert gas from said low pressure region for compression in said converging section; said jet compressor having a mixing section downstream of said converging section and said jet compressor further including a diverging section downstream of said mixing section; a residence time chamber directly connected to said diverging section wherein air or inert gas, such as nitrogen, is intimately mixed with said oil in said mixing section and said diverging section and increased in pressure in said diverging section and thereafter discharged into said residence time chamber where a period of time is provided to allow for mass and heat transfer between oil droplets and surrounding air or inert gas prior to separation of the gas from the oil, such that the gas is saturated to between 95% and 100% of theoretical saturation to thereby achieve decontamination of the oil, a gas and oil separation drum, said decontaminated oil passing out from the bottom of said separation drum and the contaminants leaving with the gas from said separation drum.

2. Apparatus as claimed in claim 1, further comprising a heat exchanger for heating the contaminated oil upstream of said jet compressor.

3. Apparatus as claimed in claim 1, further comprising a feed/effluent heat exchanger for cooling the decontaminated oil and means for maintaining said separation drum at a pressure above atmospheric pressure.

4. Apparatus as claimed in claim 1, further comprising an oil reservoir and a liquid jet pump for pumping decontaminated oil back to said oil reservoir; said liquid jet pump being located remote from said oil reservoir and below the oil level within said separation drum for enabling said separation drum to be operated at atmospheric pressure.

5. Apparatus as claimed in claim 1, further comprising a mechanical pump for pumping decontaminated oil from said separation drum.

6. Apparatus as claimed in claim 1, further comprising a closed loop gas connection between said separation drum and said converging section for allowing the reuse of the gas phase to economize on the circulating gas used in the decontamination of the oil and a pump for returning the decontaminated oil from said separation drum.

7. Apparatus as claimed in claim 1, further comprising a source of nitrogen or carbon dioxide for removing contaminants such as water and oxygen from edible oils so that oxidation is inhibited and the need for antioxidant addition is minimized.

8. A process for the decontamination of oil which can be lubricating oil, seal oil, hydraulic oil or transformer oil, with the contaminants being water and/or dissolved fuels and/or dissolved gases, said process comprising providing a jet compressor having a converging section defining a low pressure region; directing oil through an oil jet located in said converging section and drawing air or inert gas from said low pressure region for compression in said converging section; said jet compressor having a mixing section downstream of said converging section and said jet compressor further including a diverging section downstream of said mixing section; and further providing a residence time chamber directly connected to said diverging section; directing contaminated oil through said oil jet into said mixing chamber and drawing air or inert gas into the converging section as the contaminated oil is directed into the converging section; thereafter passing the contaminated oil and the air or inert gas into said mixing chamber for producing a first mixing therebetween; thereafter passing the first mixture of air and oil into the diverging section for producing a second mixing therebetween and discharging the second mixing of air and oil into the residence time chamber so that air or inert gas such as nitrogen is intimately mixed with said oil in said mixing section and said diverging section and said mixed oil and gas are maintained in their mixed state within said residence time chamber where a period of time is provided to allow for mass and heat transfer between oil droplets and surrounding air or inert gas prior to separation of the gas from the oil such that the gas is saturated to between 95% and 100% of theoretical saturation, to thereby achieve decontamination in the oil, providing a separation drum, and passing the decontaminated oil out from the bottom of the separation drum and passing the contaminants and the gas from the top of the separation drum.

9. A process as claimed in claim 8, further comprising heating the contaminated oil upstream of the jet compressor.

10. A process as claimed in claim 8, further comprising providing a feed/effluent heat exchanger, cooling the decontaminated oil in the feed/effluent heat exchanger while maintaining the separation chamber at a pressure above atmospheric pressure.

11. A process as claimed in claim 8, further comprising providing a liquid jet pump and a oil reservoir, locating the liquid jet pump remote from said oil reservoir and below the oil level within the separation drum, and pumping decontaminated oil from the separation drum back to the oil reservoir while operating the separation drum at atmospheric pressure.

12. A process as claimed in claim 8, further comprising providing a mechanical pump, and pumping decontaminated oil from the separation drum by use of the mechanical pump.

13. A process as claimed in claim 8, further comprising providing a closed loop gas connection between the separation drum and the jet compressor and directing gas therebetween to minimize on the circulating gas used in the decontamination of the oil.

14. A process as claimed in claim 8, further comprising providing a source of inert gas including either nitrogen or carbon dioxide and removing contaminants such as water and oxygen from edible oils with the inert gas so that oxidation of the edible oil is inhibited for minimizing the need for antioxidant chemicals.

15. Apparatus for the decontamination of oil including a jet compressor in combination with a residence time chamber; said jet compressor having a converging section communicating with air or inert gas; an oil jet located in said converging section; said jet compressor having a mixing section downstream of said converging section and said jet compressor further including a diverging section downstream of said mixing section; said residence time chamber being directly connected to said diverging section whereby air or inert gas may be drawn through said converging section and intimately mixed with oil to be decontaminated within said mixing section and said diverging section and held within said residence time chamber prior to separation of gas and contaminants from said oil.

16. A process for the decontamination of oil comprising intimately mixing air and/or inert gas with said oil to be decontaminated comprising the steps of providing a jet compressor having a converging section and a mixing section downstream of said converging section and said jet compressor further including a diverging section downstream of said mixing section; and further providing a residence time chamber directly connected to said diverging section and directing contaminated oil through said converging section while drawing air or inert gas into the converging section as the contaminated oil is directed into the converging section; thereafter passing the contaminated oil and the air and/or inert gas into said mixing chamber for producing a first mixing therebetween; thereafter passing the first mixture of air and oil into the diverging section for producing a second mixing therebetween and discharging the second mixing of air and oil into the residence time chamber so that air and/or inert gas is intimately mixed with said oil in said mixing section and said diverging section and said mixed oil and gas are maintained in their mixed state within said residence time chamber where a period of time is provided to allow for mass and heat transfer between oil droplets and surrounding air or inert gas and, thereafter separating gas and contaminants from said oil.

* * * * *